US007500821B2

(12) United States Patent
Watz

(10) Patent No.: US 7,500,821 B2
(45) Date of Patent: Mar. 10, 2009

(54) VACUUM PUMP

(75) Inventor: Robert Watz, Weilburg (DE)

(73) Assignee: Pfeiffer Vacuum GmbH, Asslar (DE)

( * ) Notice: Subject to any disclaimer, the term of this patent is extended or adjusted under 35 U.S.C. 154(b) by 952 days.

(21) Appl. No.: 10/771,753

(22) Filed: Feb. 4, 2004

(65) Prior Publication Data

US 2004/0156713 A1 Aug. 12, 2004

(30) Foreign Application Priority Data

Feb. 7, 2003 (DE) ..... 103 05 038

(51) Int. Cl.
*F01D 5/08* (2006.01)

(52) U.S. Cl. ..... 415/90; 415/175; 415/178

(58) Field of Classification Search ..... 415/143, 415/175, 176, 177, 178, 90; 417/423.14, 417/423.4

See application file for complete search history.

(56) References Cited

U.S. PATENT DOCUMENTS 1,136,957 A * 4/1915 Hettinger ..... 415/72
1,288,728 A * 12/1918 Spencer ..... 415/199.3
1,601,531 A * 9/1926 Jeannin ..... 310/57
2,887,062 A * 5/1959 Cametti et al. ..... 417/357
3,142,155 A * 7/1964 Levesque et al. ..... 60/806
4,073,338 A * 2/1978 Fujikake et al. ..... 165/86
5,154,573 A * 10/1992 Buse ..... 415/110
5,720,174 A 2/1998 Mathes et al.
RE36,610 E 3/2000 Kuriyama et al.
6,478,534 B2 * 11/2002 Bangert et al. ..... 415/1
6,679,677 B2 1/2004 Yamauchi et al.

FOREIGN PATENT DOCUMENTS

DE 4020015 12/1993
DE 4237972 5/1994
DE 9724323 12/1998
EP 0819856 1/1998
JP 11315794 A * 11/1999

* cited by examiner

*Primary Examiner*—Edward Look
*Assistant Examiner*—Aaron R Eastman
(74) *Attorney, Agent, or Firm*—Abelman, Frayne & Schwab

(57) ABSTRACT

A vacuum pump including a tempering component arrangeable between the suction side flange of the pump and the connection flange of a recipient and having a tempering element.

5 Claims, 3 Drawing Sheets

VACUUM PUMP

BACKGROUND OF THE INVENTION

1. Field of the Invention

The present invention relates to a vacuum pump including a flange provided on the pump suction side for connection with a connection flange of a recipient.

2. Description of the Prior Art

Vacuum pumps, in which the present invention can be used with maximum effect, are rotatable pumps, and, in particular, friction pumps. They are formed, as a rule, of a plurality of stages which can have different configurations and which are formed of respective rotor and corresponding stator components. The to-be-delivered gas flows through these pump active components. In order to achieve optimal pump characteristics such as a maximum gas flow rate, compression etc., rotatable parts should rotate with a high speed. The drive energy, which is necessary to provide for a high angular speed, is converted partially into a kinetic energy. However, a large portion of the drive energy dissipates in form of heat losses. Other undesirable heat is generated in bearings (mechanical losses caused by friction in ball bearings or electrical losses in magnetic bearings) and as a result of compression and gas friction.

Conventionally, in order to obtain an ultra high vacuum in a recipient attached to the suction flange, the recipient is heated. This permits to obtain a desired vacuum in a shorter period of time than with a non-heated recipient.

As a result, a substantial amount of heat dissipates due to operation of the pump and heating of the recipient. The amount of gas, which is delivered by a vacuum pump depends, among others, on the temperature of the compression chamber. At high temperatures, a gas quantity per unit of volume is smaller than at low temperatures. Therefore, measures are taken to reduce the temperature of the compression chamber. The rotor temperature is influenced by carrying off heat to the pump housing. With a cooled pump housing and, thus, at a greater temperature difference between the rotor and the housing, the heat generated by the rotor dissipates more easily. This, in turn, permits to increase the amount of pumped gas. In addition, a lower rotor temperature positively influences the service life of the pump.

According to the existing state of the art, conventional vacuum pumps are directly connected with a recipient. Many vacuum pumps include cooling devices which are integrated in the pump housing. Such a rigid construction can be produced only with increased manufacturing costs. Moreover, these costs are transferred to applications which may not require cooling at a corresponding location.

Accordingly, an object of the invention is to provide a vacuum pump with the heat, which is generated during the pump operation, being effectively removed.

Another object of the present invention is to provide a vacuum pump with an effective heat removal and which is constructionally simple, can be economically produced, and is easily adaptable to different applications.

SUMMARY OF THE INVENTION

These and other object of the present invention, which will become apparent hereinafter, are achieved by providing the vacuum pump with a tempering component for arrangement between the pump suction flange and the recipient connection flange.

The tempering component according to the present invention has a simple construction and can be used in principle with each vacuum pump both in high-vacuum region and forvacuum region. If needed a plurality of tempering components can be assembled together. By varying the temperature of the tempering fluid, the temperature at different locations of the pump can be adjusted as required. Thereby, the thermal characteristics can be optimally adapted to the application field and the operational conditions. In particular, there exists a possibility, e.g., to obtain a high temperature at the forvacuum side to prevent condensation at this location.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
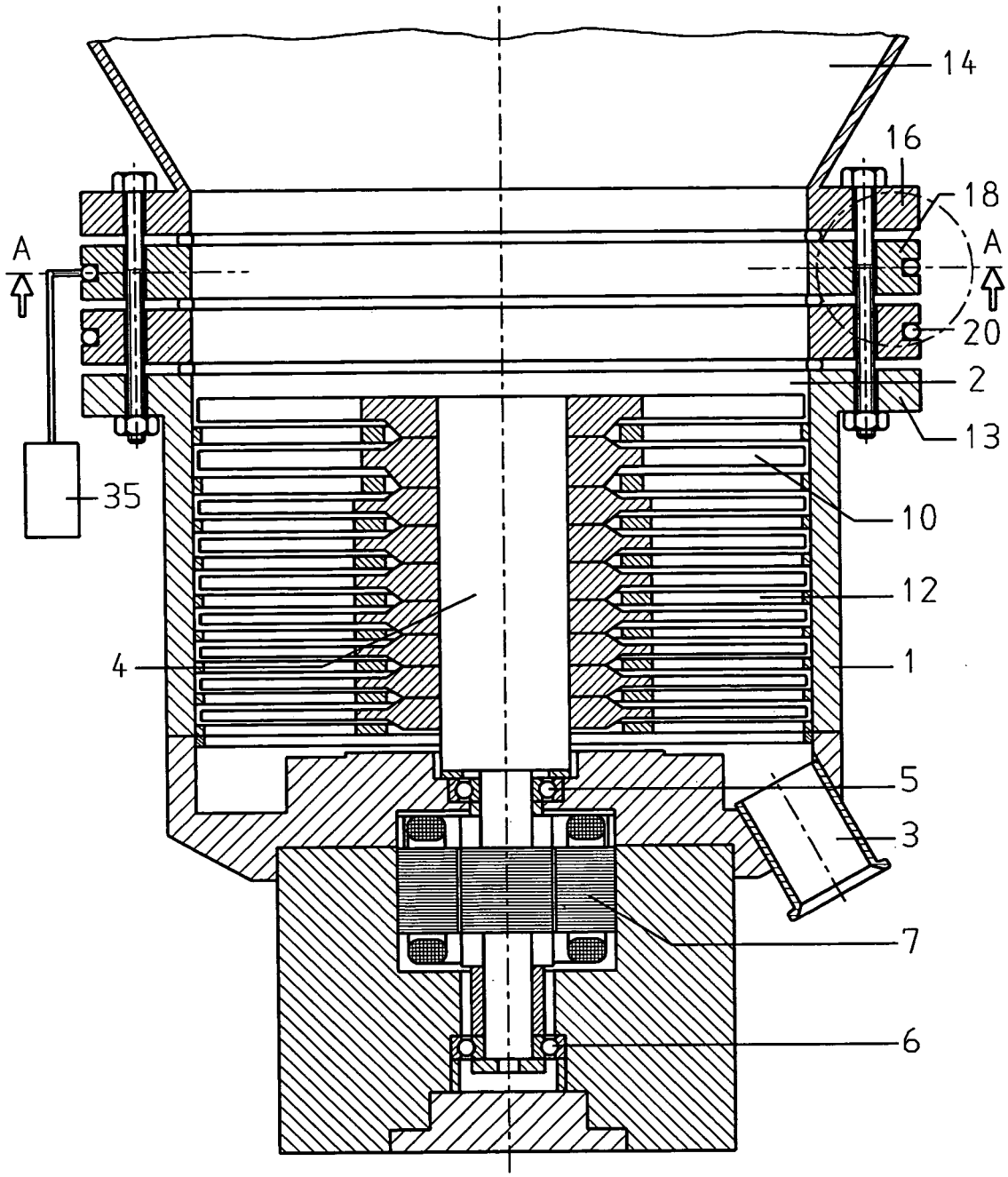
FIG. 1. a cross-sectional view of a turbomolecular pump according to the present invention.

A turbomolecular pump according to the present invention, which is shown in FIG. 1, has a housing 1 having a suction opening 2 and a gas outlet opening 3. The pump further includes a rotor shaft 4 which is supported in bearings 5 and 6 and is driven by a motor 7. A plurality of rotor discs 10 is secured on the rotor shaft 4. The rotor discs 10 are provided with a pumping active structure and cooperate with stator discs 12 having a similar pumping active structure, whereby a pumping effect is obtained.

Between the flange 13, which is provided on the suction side of the housing 1, and a connection flange 16 of a recipient 14, there is provided, according to the present invention, a separate component 18 which includes a tempering device 20.

Figure 2:
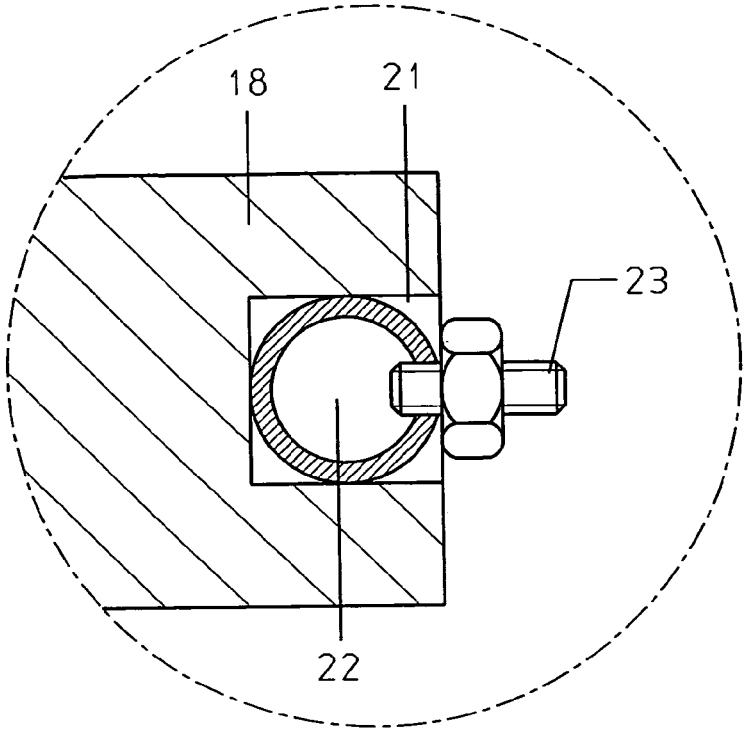
FIG. 2. a detailed view of a section of the pump shown in FIG. 1.

According to a first embodiment of the turbomolecular pump shown in FIG. 2, the component 18 is provided with a circumferential groove 21 for receiving a tubular hollow body 22. The tempering fluid flows through the hollow body 22 that has an inlet union 23 and an outlet union (not shown in the drawings).

Figure 3:
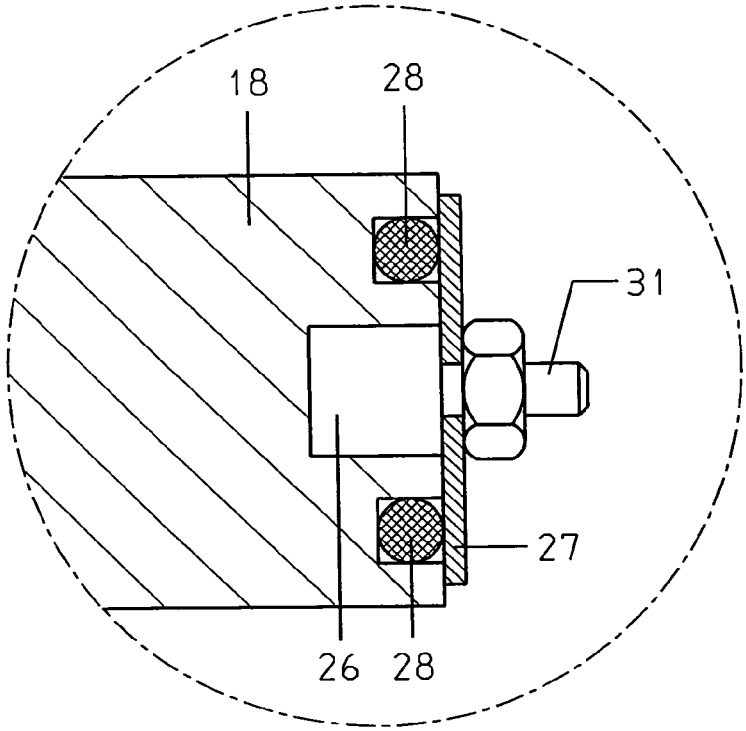
FIG. 3. a detailed view of the same section of a pump according to another embodiment.

In the embodiment of a turbomolecular pump shown in FIG. 3, the component 18 is provided likewise with a circumferential groove 26 which is closed with a sleeve 27 and a sealing element 28. The tempering fluid flows through the groove 26, entering through the inlet union 31 and exiting through an outlet union (not shown).

Figure 4:
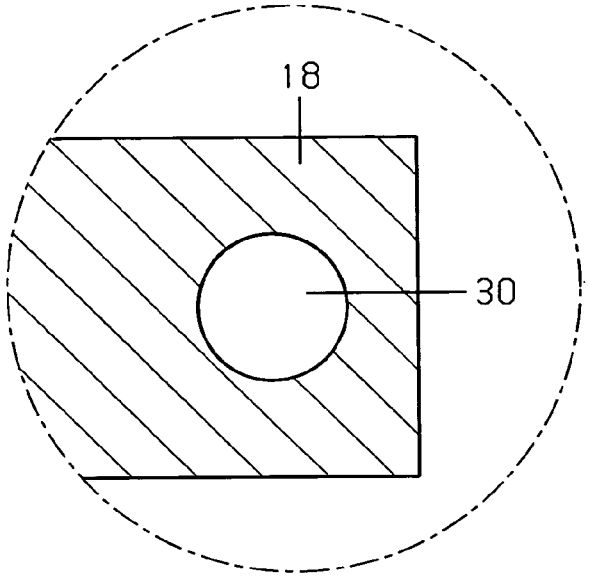
FIG. 4. a detailed view of the same section according to a further embodiment.
Figure 4A:
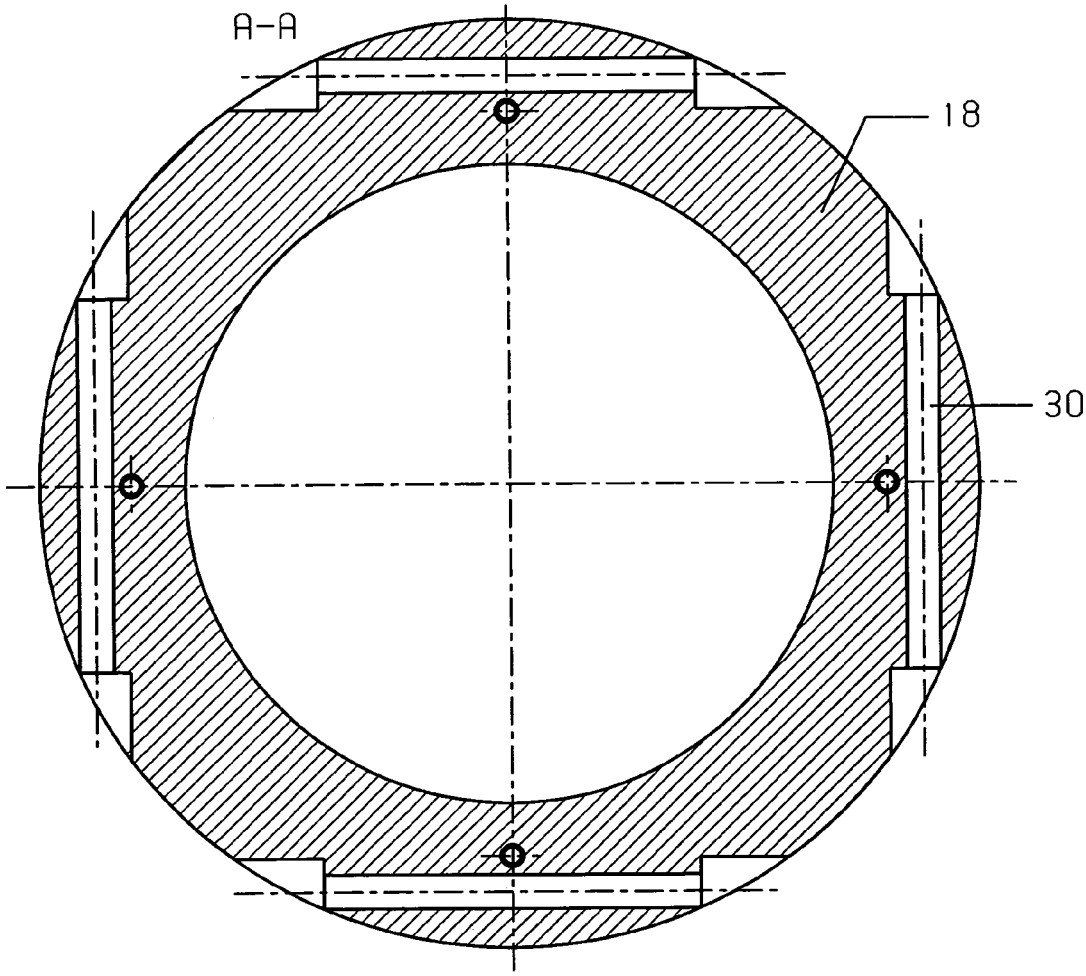
FIG. 4A a cross-sectional view, along line A-A in FIG. 1, taken perpendicular to the axis, of the embodiment shown in FIG. 4.

A further embodiment of the component 18 is shown in FIG. 4. FIG. 4A shows a cross-sectional plan view of the component 18 shown in FIG. 4. In the embodiment shown in FIGS. 4-4A, the component 18 is provided with four bores 30 which form two pairs of diametrically opposite bores extending, respectively, parallel to a horizontal axis of the component 18 and perpendicular thereto, and through which the tempering fluid flows.

According to the present invention, a plurality of separate components 18 can be provided between the pump and the recipient. The temperature of the fluid, which flows through the component 18, can be controlled by a temperature control device 35 in per se known manner.

The provision of a component 18 according to the present invention improves removal of the heat from the pump flange and provides for a thermal decoupling of the recipient. The temperature control is independent from the pump cooling circuit. The existing systems can be easily equipped with one or more tempering components. The provision of tempering component according to the present invention permits not only to cool the pump flange but also to improve the general temperature control in the application region of a pump.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A vacuum pump, comprising a flange provided on a suction side of the pump for connection with a connection flange of a recipient; and a separate tempering component to be arranged between the suction side flange of the pump and the recipient connection flange and including a circumferential groove provided in an outer circumferential surface of the tempering component and opening outwardly, means for enabling circulation of cooling medium through the circumferential groove, and union means connectable with an outside source of the cooling medium for feeding the cooling medium to the circumferential groove, and wherein the tempering component has a plurality of bores through which connection means for connecting the recipient and the pump is extendable.

2. A vacuum pump as set forth in claim 1, further comprising temperature control means connected with the tempering component.

3. A vacuum pump as set forth in claim 1, wherein a plurality of tempering components is provided between the suction side flange and the recipient connection flange.

4. A vacuum pump as set forth in claim 1, wherein the circulation enabling means comprises a hollow body received in the circumferential groove, and the union means is connected with the hollow body.

5. A vacuum pump as set forth in claim 1, wherein the circulation enabling means comprises a sleeve for closing the groove and sealing means associated with said sleeve.

* * * * *